US006805272B1

(12) United States Patent
Sen-Mu et al.

(10) Patent No.: US 6,805,272 B1
(45) Date of Patent: Oct. 19, 2004

(54) PNEUMATIC NAIL DRIVER

(76) Inventors: Yang Sen-Mu, No. 2-39, Hsin-Da Lane, Hsin-Chieh Village, Mingchien Hsiang, Nantou Hsien (TW); Tsai Chih-Wei, No. 243-1, Ming-Sheng Rd., Wufon Hsiang, Taichung Hsien (TW)

( * ) Notice: Subject to any disclaimer, the term of this patent is extended or adjusted under 35 U.S.C. 154(b) by 0 days.

(21) Appl. No.: 10/635,760

(22) Filed: Aug. 6, 2003

(51) Int. Cl.[7] ..... B25C 5/06
(52) U.S. Cl. ..... 227/130; 227/113; 173/169
(58) Field of Search ..... 227/130, 52, 55, 227/113; 173/115, 169

(56) References Cited

U.S. PATENT DOCUMENTS 3,438,449 A * 4/1969 Smith ..... 173/17
3,563,438 A * 2/1971 Doyle et al. ..... 227/8
3,584,775 A * 6/1971 Volkmann et al. ..... 227/130
5,181,450 A * 1/1993 Monacelli ..... 91/41
6,095,256 A * 8/2000 Lindsay ..... 173/115
6,095,394 A * 8/2000 Wang-Kuan ..... 227/130
6,138,888 A * 10/2000 Liao ..... 227/130
6,364,192 B1 * 4/2002 Lin ..... 227/113
6,488,102 B2 * 12/2002 Lindsay ..... 173/115
6,508,315 B1 * 1/2003 Lindsay ..... 173/115
6,598,775 B1 * 7/2003 Chen ..... 227/113
6,691,798 B1 * 2/2004 Lindsay ..... 173/115

* cited by examiner

*Primary Examiner*—Scott A. Smith
*Assistant Examiner*—Brian Nash

(57) ABSTRACT

A pneumatic nail driver includes a main body having a cavity defined for receiving a spring and a sleeve that has an annular groove defined in an outer periphery of the sleeve. A passage is defined in the main body and selectively communicates with the annular groove for allowing the compressed air flow into the sleeve. A block and a cylinder are sequentially received in the cavity. A striker is reciprocally movably received in the cylinder due to the block and the compressed air. A shaft partially longitudinally extends into the cylinder and the striker is moved to strike the shaft for driving the nail when the shaft and the cylinder are backward pushed to make the annular groove communicate the passage to guide the compressed air flowing to the cylinder for pushing the striker.

5 Claims, 5 Drawing Sheets

PNEUMATIC NAIL DRIVER

BACKGROUND OF THE INVENTION

1. Field of the Invention

The present invention relates to a nail driver, and more particularly to a pneumatic nail driver.

2. Description of Related Art

As usual, a conventional pneumatic nail driver uses the compressed air for suddenly pushing a piston in the pneumatic nail driver. The pushed piston drives a striking pin to drive a nail that is arranged in a front end of the conventional pneumatic nail driver. However, the conventional pneumatic nail driver usually used to drive clipped nail not for a single nail. Furthermore, the user needs to wrench the trigger of the conventional pneumatic nail driver for striking the clipped nail. However, the trigger has a complicated structure and hard to be assembled and a sudden strike may happened. It is very dangerous to the worker.

The present invention has arisen to mitigate and/or obviate the disadvantages of the conventional pneumatic nail driver.

SUMMARY OF THE INVENTION

The main objective of the present invention is to provide an improved pneumatic nail driver that can be used to strike a single nail and prevent the pneumatic nail from a sudden strike.

To achieve the objective, the pneumatic nail driver in accordance with the present invention comprises a main body having a cavity defined for receiving a spring and a sleeve that has an annular groove defined in an outer periphery of the sleeve. A passage is defined in the main body and selectively communicates with the annular groove for allowing the compressed air flow into the sleeve. A block and a cylinder are sequentially received in the cavity. A striker is reciprocally movably received in the cylinder due to the block and the compressed air. A shaft partially longitudinally extends into the cylinder and the striker is moved to strike the shaft for driving the nail when the shaft and the cylinder are backward pushed to make the annular groove communicate the passage to guide the compressed air flowing to the cylinder for pushing the striker.

Further benefits and advantages of the present invention will become apparent after a careful reading of the detailed description with appropriate reference to the accompanying drawings.

DETAILED DESCRIPTION OF THE INVENTION

Figure 1:
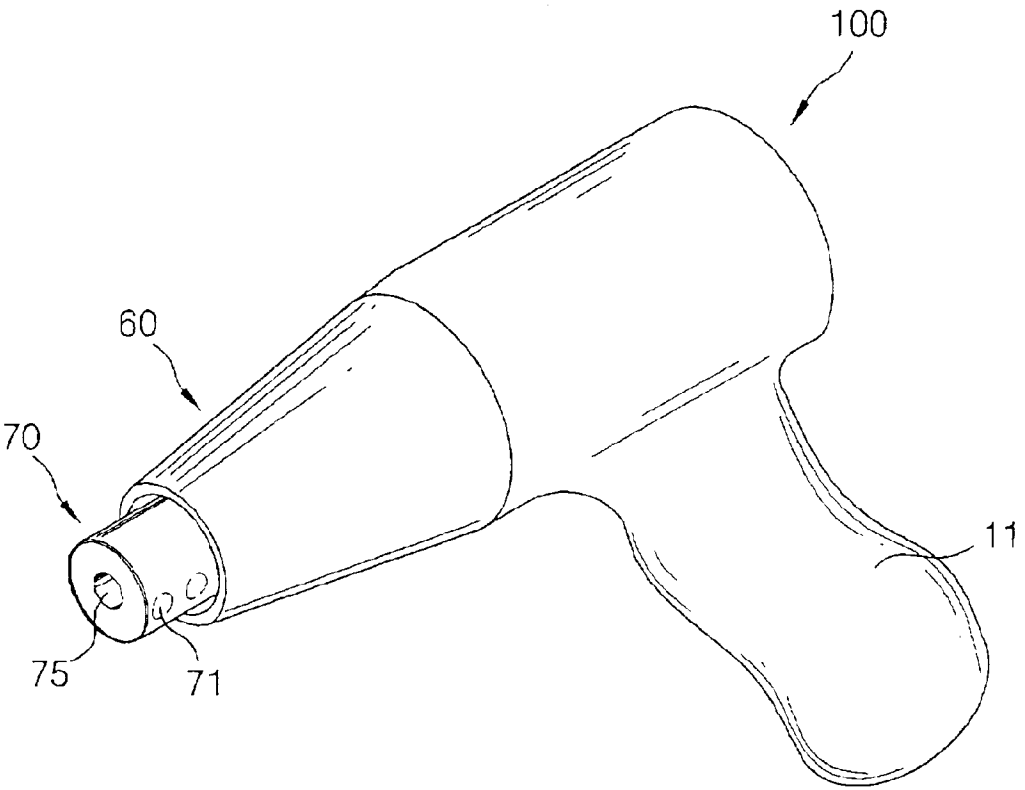
FIG. 1 is a perspective view of a pneumatic nail driver in accordance with the present invention.
Figure 2:
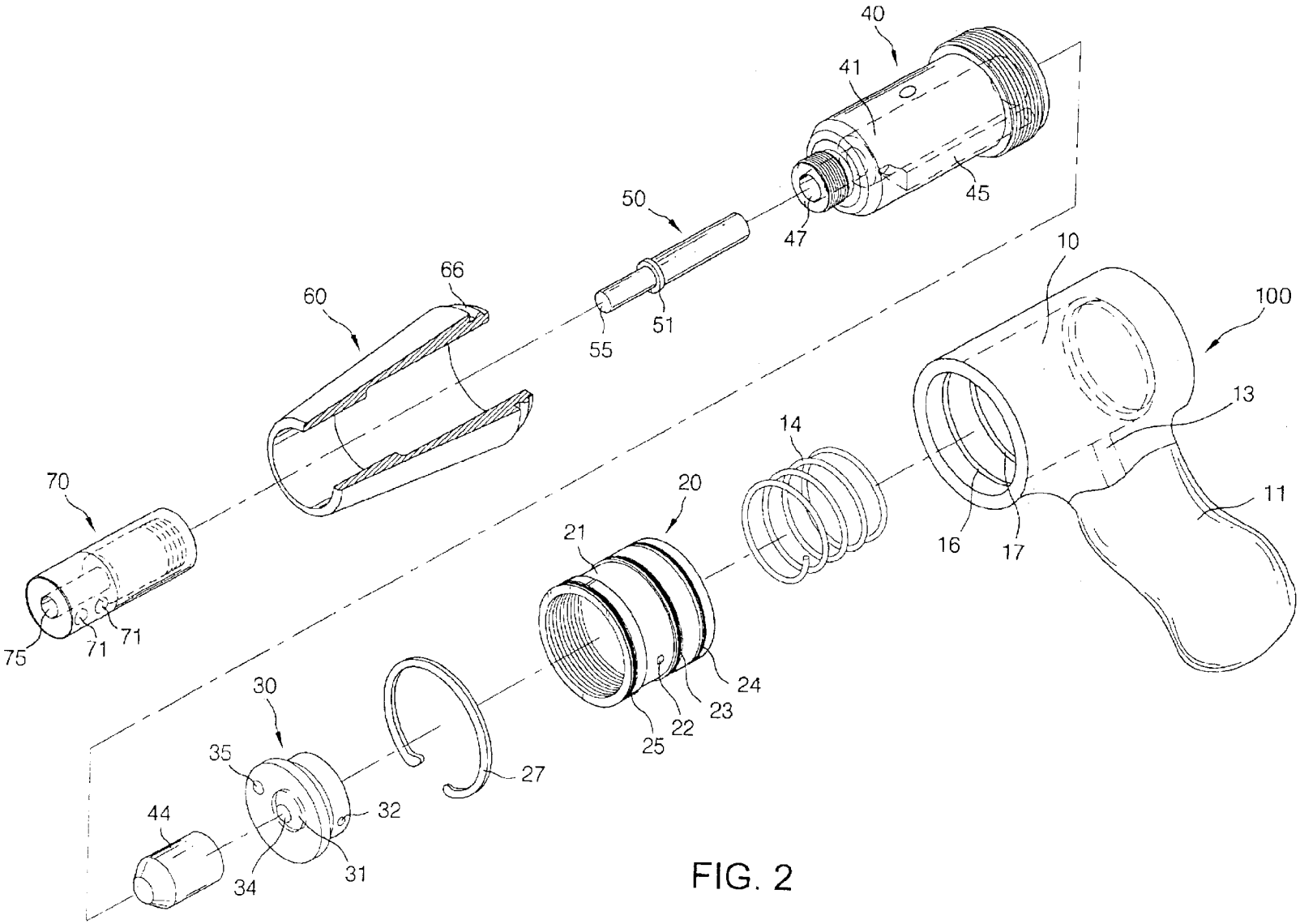
FIG. 2 is an exploded perspective view of the pneumatic nail drive in FIG. 1.

With reference to the drawings and initially to FIGS. 1 and 2, a pneumatic nail driver in accordance with the present invention comprises a main body (100), a sleeve (20) slidably received in the main body (100), a block (30) received in the sleeve (20), a cylinder (40) mounted to the sleeve (20) and partially extending through the main body (100) toward a front end of the main body (100), a striking shaft (50) partially slidably received in the cylinder (40), a collar mounted to the front end of the main body (100) for partially receiving the cylinder (40) and a holder (70) longitudinally connected the cylinder (40) for holding the nail (80) in place before being fully driven into the workpiece.

The main body (100) includes a cavity (10) defined therein and a handle (11) extending from the main body (100). The cavity (10) has an open end defined in the front end of the main body (100) and a close end formed opposite to the open end of the cavity (10). A passage (13) is defined in the handle (11) and communicates with the cavity (10) in the main body (100). The passage (13) is adapted to be connected to a compressed air source such that the compressed air can flow into the cavity (10) via the passage (13). A spring (14) is compressively received in the cavity (10). The spring (14) has a first end abutting the close end of the cavity (10) and a second end opposite to the first end of the spring (14). A first annular groove (16) and a second annular groove (17) are respectively defined in an inner periphery of the cavity (10) near the front end of the main body (100). The distance between the front end of the main body (100) and the first annular groove (16) is shorter than that between the front end of the main body (100) and the second annular groove (17).

The sleeve (20) includes a close end abutting the second end of the spring (14) and an open end facing the front end of the main body (100). The sleeve (20) includes an annular groove (21) defined in an outer periphery thereof near the open end of the sleeve (20). A hole (22) is defined in a bottom of the annular groove (21) and radially extending through the sleeve (20). The annular groove (21) selectively communicates with the passage (13) such the hole (22) allows the compressed air flow into the sleeve (20) when the annular groove (21) communicates with the passage (13). A C-shaped ring (27) is engaged to the second annular groove (17) in the inner periphery of he cavity (10) to limit a stroke of the sleeve (20) in the cavity (10).

Figure 3:
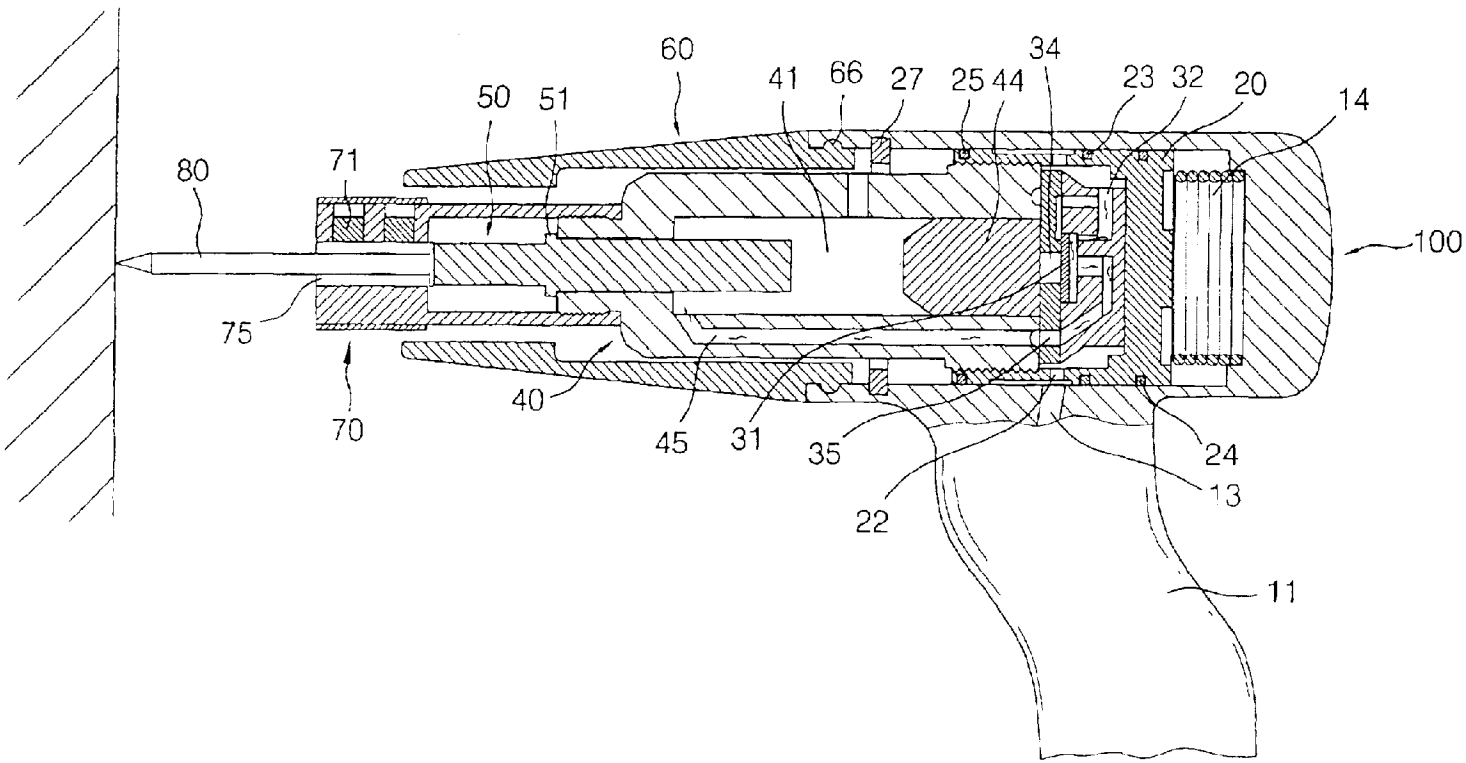
FIG. 3 is a side cross-sectional view of the pneumatic nail driver in FIG. 1.
Figure 4:
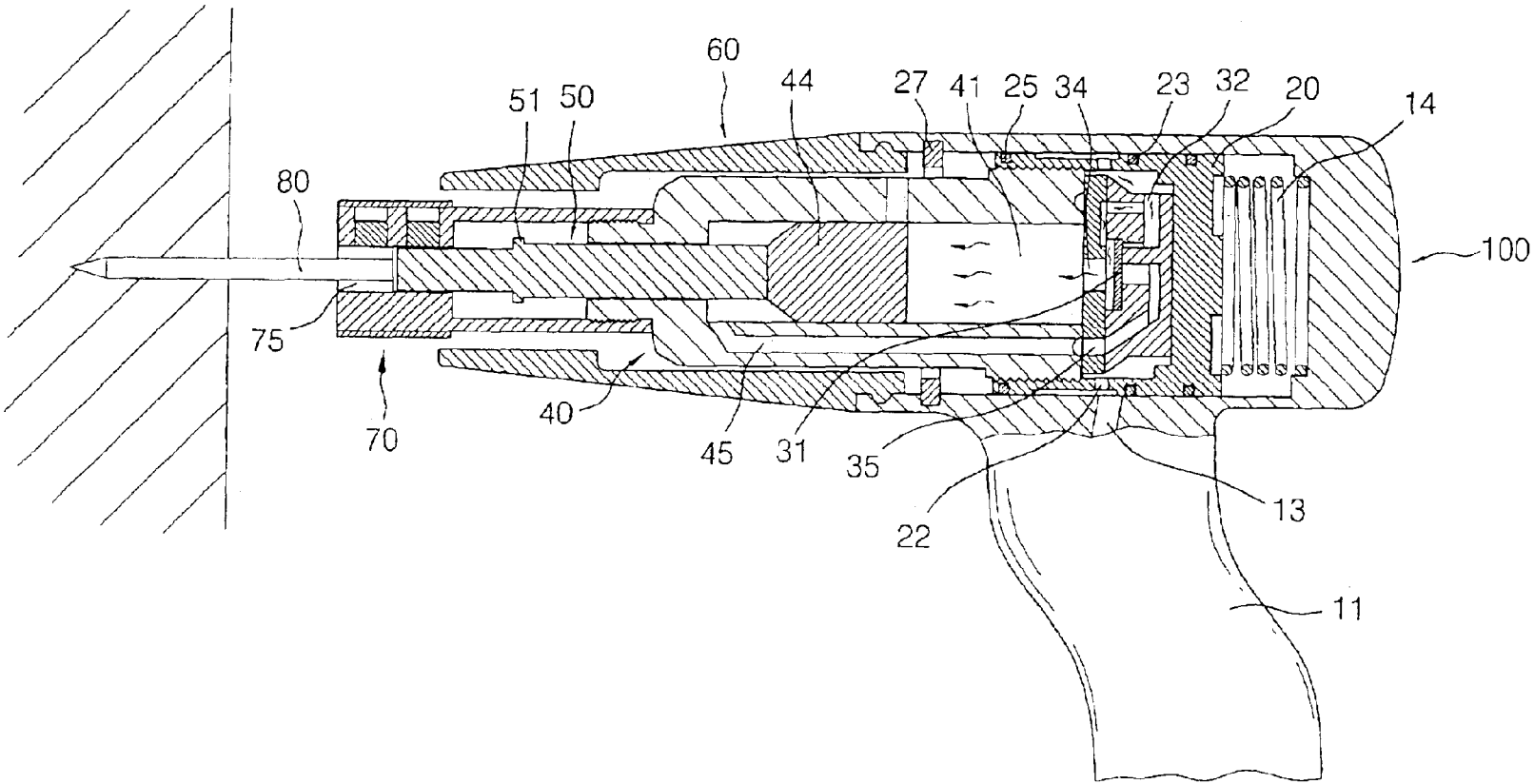
FIG. 4 is an operational side cross-sectional view of the pneumatic nail driver in FIG. 1 during driving the nail.

The block (30) is received in and abuts the close end of the sleeve (20). The block (30) includes a first side abutting the close end of the sleeve (20) and a second side opposite to the first side of the block (30). A recess (not numbered) is defined in the block (30). An inlet (32) is laterally defined in the block (30) and communicates with the recess. A first outlet (34) is centrally longitudinally defined in the second side of the block (30) and communicates with the recess. A second outlet (35) is longitudinally defined in the second side and communicates with a bottom of the recess. A valve (31) is longitudinally movably received in the recess for selectively closing the first outlet (34) and the second outlet (35). With reference to FIGS. 3 and 4, the second outlet (35) communicates with the inlet (32) when the valve (31) closes the first outlet (34) and the first outlet (34) communicates with the inlet (32) when the valve (31) closes the second outlet (35).

The cylinder (40) has a first end securely received in the sleeve (20) and a first side abutting the block (30) to hold the block (30) in place. The cylinder (40) has a first hole (41) longitudinally centrally defined in the first side of the cylinder (40) and communicating with first outlet (34) in the block (30). A striker (44) is reciprocally movably received in the first hole (41). A path (45) is defined in the first side of the cylinder (40). The path (45) extends to laterally communicate with the first hole (41) and communicates with the second outlet (35) in the block (30) when the first end of the cylinder (40) is secured in the sleeve (20). A second hole (47) is longitudinally centrally defined in a second end of the cylinder (40) and longitudinally communicates with the first hole (41).

The shaft (50) is partially longitudinally and movably received in the cylinder (40). The shaft (50) includes a stopper (51) radially extending from an outer periphery of the shaft (50) to divide the shaft (50) into a first section and a second section. The stopper (51) has a diameter greater than that of the second hole (47) and selectively abuts the second end of the cylinder (40) for backward pushing the cylinder (40) and the sleeve (20). The shaft (50) includes a striking face (55) formed on a distal end of the second section of the shaft (50).

The collar (60) is cylindrical and longitudinally mounted to the front end of the main body (100). The collar (60) has an annular protrusion (66) radially extending from an outer periphery of the collar (60) and engaged to the first annular groove (16) in the inner periphery of the cavity (10). The collar (60) is provided to protect the cylinder (40) from a bump and reduce the noise from the pneumatic nail driver during operating.

The holder (70) is securely longitudinally connected to the second end of the cylinder (40) and has a through hole (75) centrally longitudinally defined in the holder (70) and co-axially corresponding to the second hole (47) in the cylinder (40). The through hole (75) allows the second section of the shaft (50) reciprocally moved in the holder (70) to strike a nail (80) that extends into the through hole (75) in the holder (70) when the compressed air flows into the cylinder (40). At least one magnet (71) is buried in the holder (70) and adapted to hold the nail (80) in place when extending into the through hole (75) in the holder (70).

Figure 5:
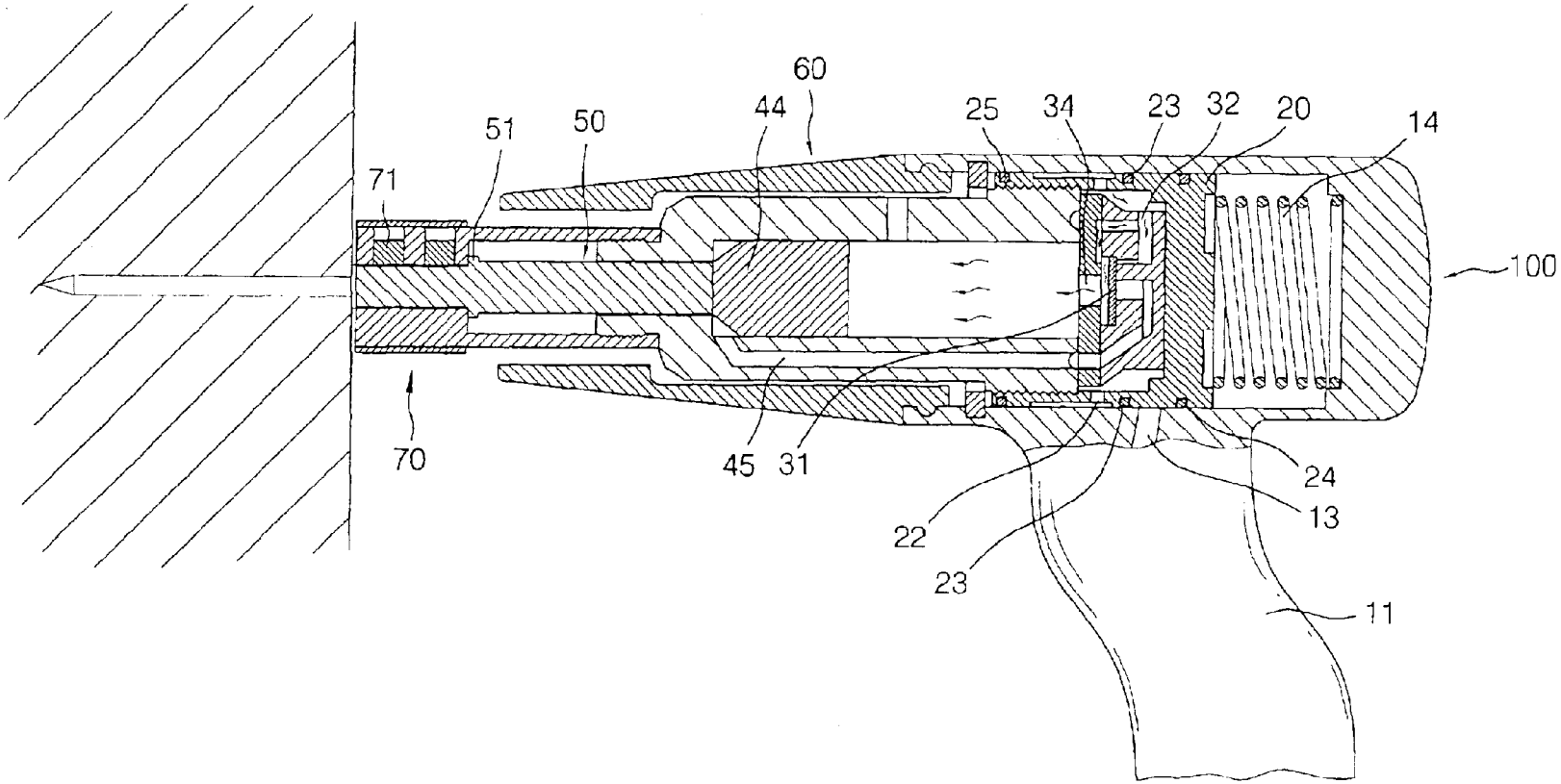
FIG. 5 is an operational side cross-sectional view of the pneumatic nail driver in FIG. 1 when the nail is fully driven into the workpiece.

As described above, with reference to FIGS. 3–5, a spring (14) and a sleeve (20) are sequentially mounted in the cavity (10) in the main body (100). The annular groove (21) in the outer periphery of the sleeve (20) selectively communicates the passage (13) in the main body (100) for allowing the compressed air flow into the sleeve (20) via the hole (22) in the sleeve (20). The sleeve (20) closes the passage (13) in the main body (100) when finishing driving the nail (80) into the workpiece and the C-shaped ring is used to limit the stroke of the sleeve (20) in the cavity (10) during operating. The block (30) is received in the sleeve (20) and the cylinder (40) is partially securely mounted in the sleeve (20) to hold the block (30) in place. The valve (31) in the block (30) can quickly intermittently guide the compressed air into the cylinder (40) to reciprocally drive the striker (44). Consequently, the striker (44) reciprocally rams the shaft (50) in a high speed to make the striking face (55) striking the nail (80) into the workpiece. Furthermore, the holder (70) is longitudinally securely connected to the second end of the cylinder (40) for guiding the shaft (50) and holding the nail (80) in place due the at least one magnet (71) during operating. The compressed air flows into the cylinder (40) to drive the striker (44) when the user forward pushes the main body (100) and the sail (80) backward pushes the shaft (50), the cylinder (40) and the sleeve (20) to make the annular groove (21) in the outer periphery of the sleeve (20) communicate with the passage (13) in the main body (100). Consequently, the trigger of the conventional pneumatic nail driver is unnecessary to the present invention such that the manufacturing processes of the present invention are simplified and a sudden strike is avoided.

Although the invention has been explained in relation to its preferred embodiment, it is to be understood that many other possible modifications and variations can be made without departing from the spirit and scope of the invention as hereinafter claimed.

What is claimed is:

1. A pneumatic nail driver comprising:

a main body including a cavity defined therein and a handle extending from the main body, the cavity having an open end defined in a front end of the main body and a close end formed opposite to the open end of the cavity, a passage defined in the handle and communicating with the cavity, the passage adapted to connected to a compressed air source such that the compressed air can flow into the cavity via passage, a spring compressively received in the cavity, the spring having a first end abutting the close end of the cavity and a second end opposite to the first end of the spring;

a sleeve slidably received in the cavity, the sleeve having a close end abutting the second end of the spring and an open end facing the front end of the main body, the sleeve including a annular groove defined in an outer periphery of the sleeve near the open end of the sleeve, a hole defined in a bottom of the annular groove and laterally extending through the sleeve, the compressed air flowing into the sleeve when the annular groove communicates with the passage in the main body, two O-rings respectively mounted around the sleeve near two opposite sides of the annular groove and a C-shaped ring laterally engaged to an inner periphery of the cavity to limit a stroke of the sleeve in the cavity;

a block received in the sleeve for controlling the compressed air, the block including a first side abutting the close end of the sleeve and a second side opposite to the first side of the block, a first outlet centrally longitudinally defined in the second side of the block, a second outlet longitudinally defined in the second side of the block and laterally communicating with the first outlet;

a cylinder longitudinally connected to and having a first end partially securely received in the sleeve, the cylinder including a first side abutting the block to hold the block in place, a first hole longitudinally centrally defined in the first side of the cylinder and communicating with the first outlet in the block, a striker reciprocally movably received in the first hole in the cylinder, a path defined in the first side of the cylinder, the path extending to laterally communicate with the first hole and communicating with the second outlet in the block, a second hole longitudinally centrally defined in a second end of the cylinder and communicating with the first hole;

a shaft partially longitudinally and movably received in the cylinder, the shaft includes a stopper radially extending from an outer periphery of the shaft to divide the shaft into a first section and a second section, the stopper having a diameter greater than that of the second hole and selectively abutting the second end of the cylinder for backward pushing the cylinder and the sleeve, the shaft including a striking face formed on a distal end of the second section of the shaft and adapted to strike a nail;

a collar being cylindrical and longitudinally mounted to the front end of the main body to protect the cylinder from a bump and reduce the noise during operating; and a holder securely longitudinally connected to the second end of the cylinder and having a through hole centrally longitudinally defined in the holder, the through hole in the holder co-axially corresponding to the second hole in the cylinder and allowing the second section of the shaft reciprocally moved in the holder to strike the nail that extends into the through hole in the holder, at least one magnet buried in the holder and adapted to hold the nail in place when the nail extends into the through hole in the holder.

2. The pneumatic nail driver as claimed in claim 1, wherein the main body comprises a first annular groove and a second annular groove respectively defined in the inner periphery of the cavity near the front end of the main body, the distance between the front end of the main body and the first annular groove being shorter than that between the front end of the main body and the second annular groove.

3. The pneumatic nail driver as claimed in claim 1, wherein the block comprises a recess defined therein and longitudinally communicating with the first outlet and the second outlet, an inlet laterally defined in the block and communicating with the recess, a valve longitudinally movably received in the recess for selectively closing the first outlet and the second outlet, wherein the second outlet communicates with the inlet when the valve closes the first outlet and the first outlet communicates with the inlet when the valve closes the second outlet.

4. The pneumatic nail driver as claimed in claim 2, wherein the C-shaped ring is engaged to the second annular groove in the inner periphery of the cavity in the main body.

5. The pneumatic nail driver as claimed in claim 2, wherein the collar comprises an annular protrusion radially extending from an outer periphery of the collar and engaged to the first annular groove in the inner periphery of the cavity in the main body.

* * * * *